US011621512B2

(12) United States Patent
Koiso

(10) Patent No.: US 11,621,512 B2
(45) Date of Patent: Apr. 4, 2023

(54) HOUSING AND CONNECTOR

(71) Applicant: I-PEX Inc., Kyoto (JP)

(72) Inventor: Koyuru Koiso, Shizuoka (JP)

(73) Assignee: I-PEX Inc., Kyoto (JP)

( * ) Notice: Subject to any disclaimer, the term of this patent is extended or adjusted under 35 U.S.C. 154(b) by 28 days.

(21) Appl. No.: 17/370,327

(22) Filed: Jul. 8, 2021

(65) Prior Publication Data

US 2022/0029335 A1 Jan. 27, 2022

(30) Foreign Application Priority Data

Jul. 27, 2020 (JP) ..... JP2020-126098

(51) Int. Cl.

| | |
|---|---|
| ***H01R 13/42*** | (2006.01) |
| ***H01R 13/50*** | (2006.01) |
| ***H01R 13/502*** | (2006.01) |
| ***H01R 13/639*** | (2006.01) |

(52) U.S. Cl.

CPC ..... *H01R 13/42* (2013.01); *H01R 13/501* (2013.01); *H01R 13/502* (2013.01); *H01R 13/639* (2013.01)

(58) Field of Classification Search

CPC .... H01R 13/42; H01R 13/501; H01R 13/502; H01R 13/639; H01R 13/5205; H01R 13/20; H01R 13/514

See application file for complete search history.

(56) References Cited

U.S. PATENT DOCUMENTS

2007/0117470 A1* 5/2007 Mueller ..... H01R 9/2408 439/752
2022/0029335 A1* 1/2022 Koiso ..... H01R 13/501

FOREIGN PATENT DOCUMENTS

CN 111313341 A * 6/2020 ..... H01R 13/506
JP 2015-122281 A 7/2015

OTHER PUBLICATIONS

CN 111313341 Translated (Year: 2020).*
English language abstract and machine-assisted English language translation of Japanese Patent Application Publication No. 2015-122281 A extracted from www.espacenet.com on Jul. 8, 2021; 14 pages.

* cited by examiner

*Primary Examiner* — Abdullah A Riyami
*Assistant Examiner* — Nader J Alhawamdeh
(74) *Attorney, Agent, or Firm* — Howard & Howard Attorneys PLLC

(57) ABSTRACT

A housing includes: a housing body on which a portion for abutment is formed; an assembly that is detachably assembled to the housing body; and a hinge with which the assembly is mounted on the housing body. The hinge includes (i) a connection that is arranged between the housing body and the assembly, and on which an abutment is formed, (ii) a first joint that is disposed between the housing body and the connection, and has flexibility, and (iii) a second joint that is disposed between the assembly and the connection, and has flexibility. The abutment formed on the connection is allowed to abut on the portion for abutment of the housing body by bending the first joint, and the assembly is assembled to the housing body by bending the second joint in a state in which the first joint is bent.

14 Claims, 10 Drawing Sheets

HOUSING AND CONNECTOR

CROSS-REFERENCE TO RELATED APPLICATION

This application claims the benefit of Japanese Patent Application No. 2020-126098, filed on Jul. 27, 2020, the entire disclosure of which is incorporated by reference herein.

FIELD

The present disclosure relates to a housing and a connector.

BACKGROUND

A housing and a connector including a terminal stored in the housing are used in connection between an electric wire and an electric wire or an electrical apparatus. As the housing, a housing to which an assembly such as a retainer or a cover covering part of the housing is attached with a hinge is known.

Unexamined Japanese Patent Application Publication No. 2015-122281 discloses a connector including: a connector housing; a retainer; and a hinge that includes two first couplers and a second coupler formed in a groove shape between the two first couplers, and couples the retainer and the connector housing to each other. An operator can rotate the retainer at 90 degrees by deforming the hinge mainly on the basis of the bottom of the second coupler when mounting the retainer on the connector housing.

In the connector disclosed in Unexamined Japanese Patent Application Publication No. 2015-122281, an angle at which the retainer rotates by the deformation of the hinge is 90 degrees. Therefore, the connector has a problem in that the retainer and other components interfere with each other, thereby resulting in poor workability. Moreover, the connector has a problem in that rotation of the retainer at more than 90 degrees for avoiding the interference between the retainer and the other components may result in breakage of the hinge.

The present disclosure was made under the above-described circumstances, with an objective to provide a housing and a connector that have excellent workability and result in reduced breakage of a hinge.

SUMMARY

In order to achieve the objective described above, a housing according to a first aspect of the present disclosure includes:

a housing body on which a portion for abutment is formed;

an assembly that is detachably assembled to the housing body; and a hinge with which the assembly is mounted on the housing body, and that includes (i) a connection that is arranged between the housing body and the assembly, and on which an abutment is formed, (ii) a first joint that is disposed between the housing body and the connection, and has flexibility, and (iii) a second joint that is disposed between the assembly and the connection, and has flexibility, wherein the abutment formed on the connection is allowed to abut on the portion for abutment of the housing body by bending the first joint, and the assembly is assembled to the housing body by bending the second joint in a state in which the first joint is bent.

It is preferable that the first joint is more easily bent than the second joint.

It is preferable that a total of a bending angle of the first joint and a bending angle of the second joint is 180 degrees.

It is preferable that each of the bending angles of the first joint and the second joint is 90 degrees.

It is preferable that the first joint includes a first flexible portion that connects the housing body and the connection to each other, and has flexibility, and the second joint includes a second flexible portion that connects the assembly and the connection to each other, and has flexibility.

It is preferable that a length of the first flexible portion in a direction along a bend line formed when the first flexible portion is bent is less than a length of the second flexible portion in a direction along a bend line formed when the second flexible portion is bent.

It is preferable that the first joint and the second joint are made of an identical material, and a thickness of a thinnest portion in the first joint is smaller than a thickness of a thinnest portion in the second joint.

It is preferable that the portion for abutment, formed on the housing body, includes at least one projection, and the abutment and a top of the projection come into contact with each other when the first joint is bent.

It is preferable that the portion for abutment, formed on the housing body, includes a first projection and a second projection, and the abutment and tops of the first projection and the second projection come into contact with each other when the first joint is bent.

It is preferable that a length of the first joint in a direction along a bend line formed when the first joint is bent is less than a spacing between the first projection and the second projection.

It is preferable that:

the first joint includes a third flexible portion and a fourth flexible portion that connect the housing body and the connection to each other, and have flexibility;

the portion for abutment, formed on the housing body, includes one projection; and a length of the projection in a direction along a bend line formed when the first joint is bent is less than a spacing between the third flexible portion and the fourth flexible portion.

In order to achieve the objective described above, a connector according to a second aspect of the present disclosure includes:

the housing; and a terminal housed in the housing.

In accordance with the present disclosure, the hinge includes the connection on which the abutment is formed, the first joint that is disposed between the housing body and the connection, and has flexibility, and the second joint that is disposed between the assembly and the connection, and has flexibility. Therefore, there can be provided the housing and the connector that have excellent workability and result in reduced breakage of the hinge.

BRIEF DESCRIPTION OF THE DRAWINGS

A more complete understanding of this application can be obtained when the following detailed description is considered in conjunction with the following drawings, in which.

DETAILED DESCRIPTION

A housing and a connector according to an embodiment for carrying out the present disclosure will be described below with reference to the drawings.

Figure 1:
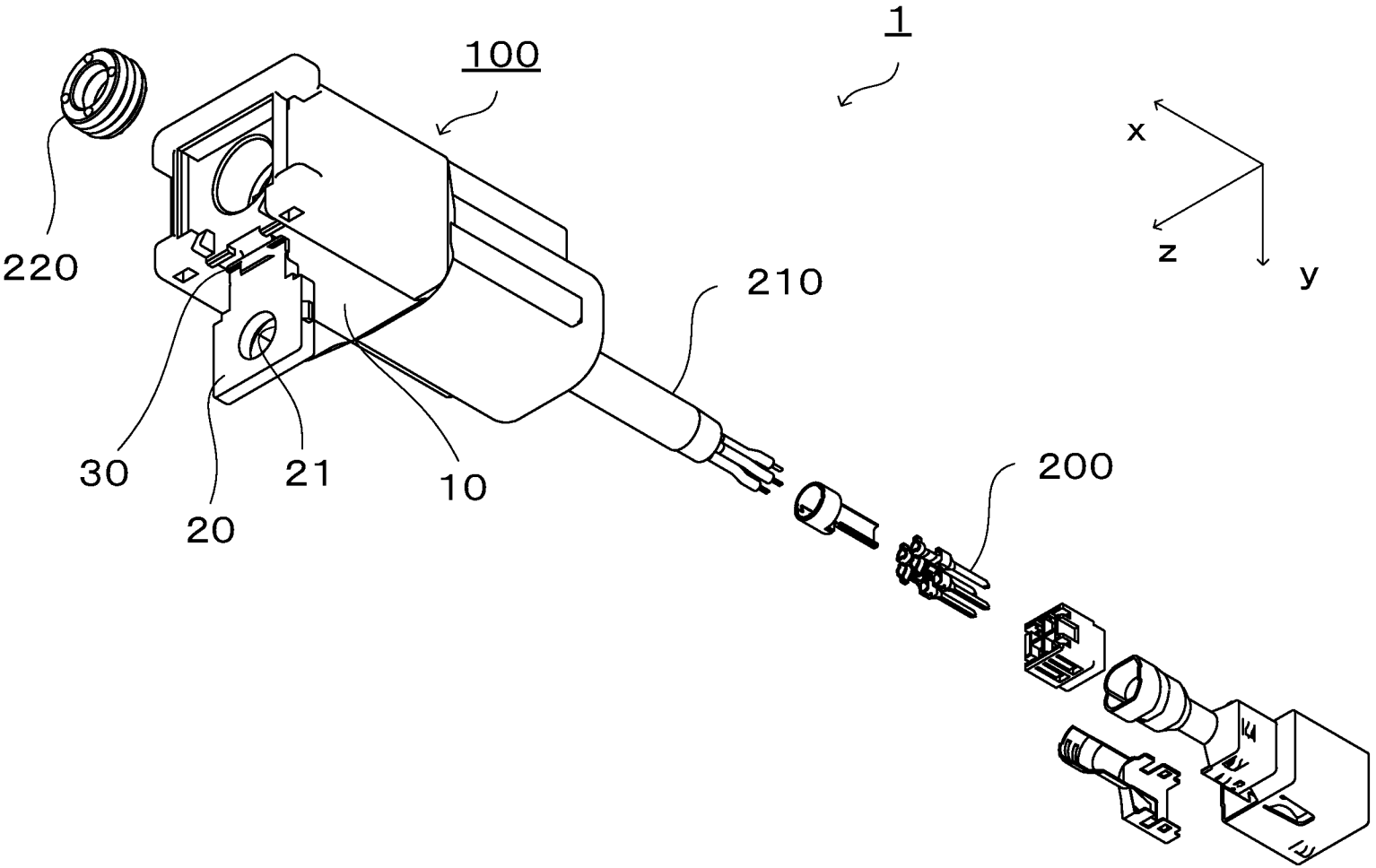
FIG. 1 is an exploded view illustrating a connector according to an embodiment of the present disclosure.

The connector 1 according to the present embodiment includes: the housing 100; a terminal 200 housed in the housing 100; a cable 210 connected to the terminal 200; and a gasket 220 that seals a connection portion between the housing 100 and the cable 210, as illustrated in FIG. 1. The connector 1 is used, for example, for electrically connecting an electronic circuit for automobile use.

Figure 2:
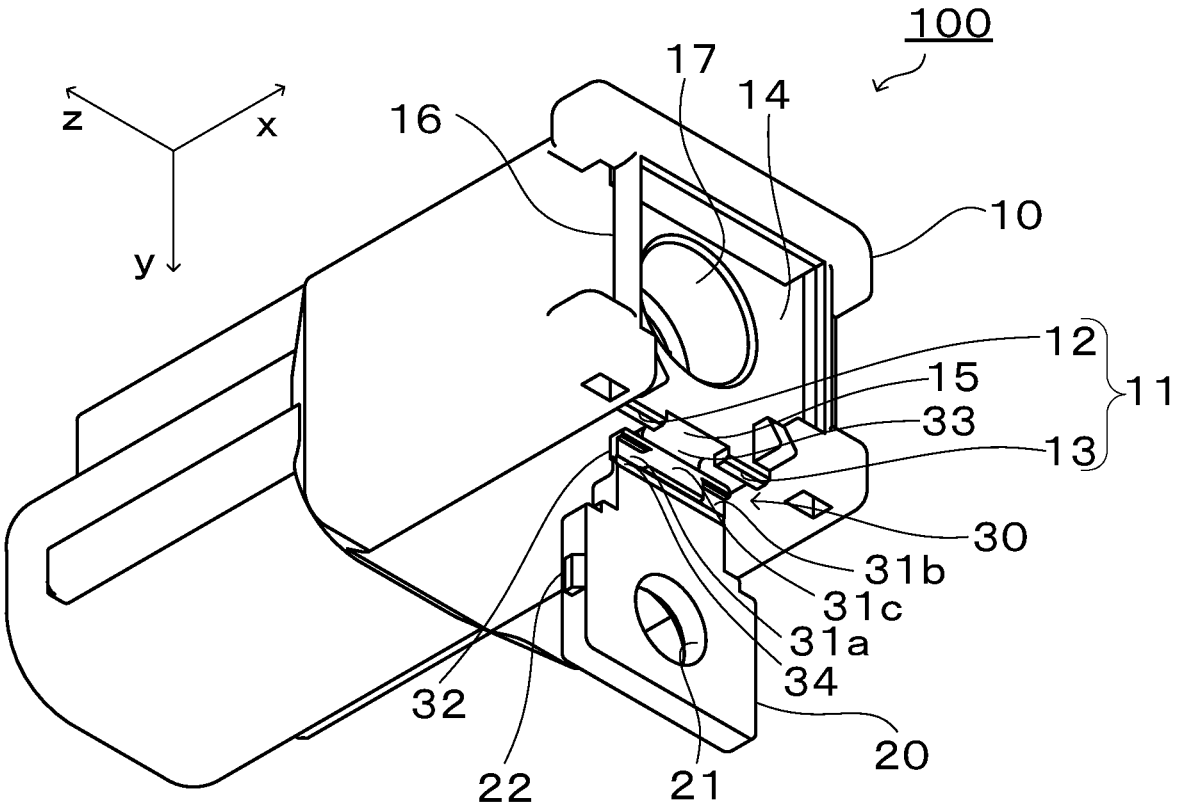
FIG. 2 is a perspective view illustrating a housing according to the embodiment of the present disclosure.
Figure 3:
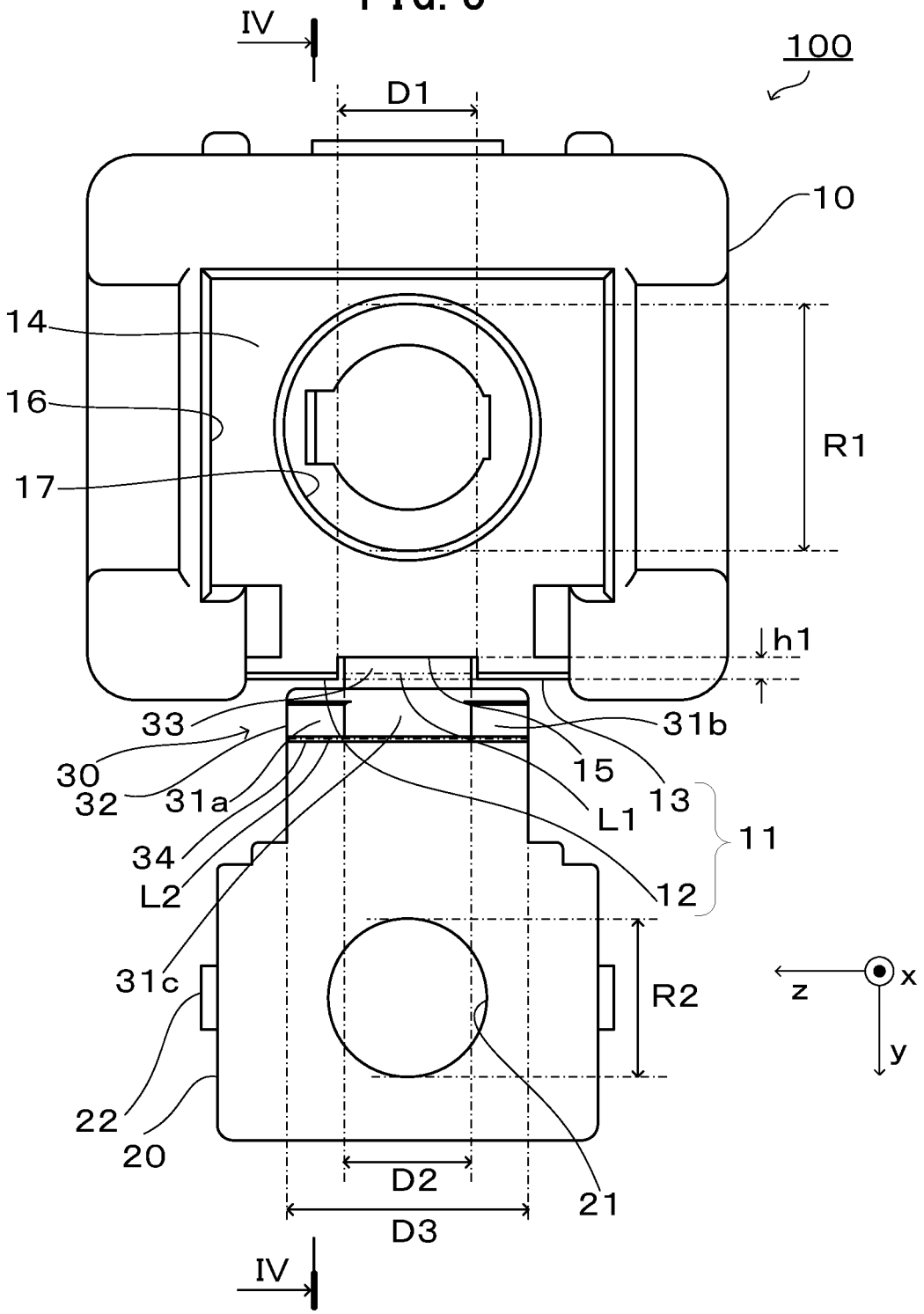
FIG. 3 is a front view illustrating the housing according to the embodiment of the present disclosure.

The housing 100 includes a housing body 10, an assembly 20, and a hinge 30, as illustrated in FIGS. 2 and 3. The assembly 20 is detachably assembled to the housing body 10. The hinge 30 is arranged between the housing body 10 and the assembly 20, and the assembly 20 is mounted on the housing body 10 with the hinge 30. The housing body 10, the assembly 20, and the hinge 30 are made by integrally molding a resin in a mold.

For facilitating understanding, an orthogonal coordinate system is set in which a direction in which a mating connector is inserted into the connector 1 is set at the x-direction, a direction in which the hinge 30 is attached, viewed from the housing body 10, is set at the y-direction, and a direction that is perpendicular to the x-direction and the y-direction is set at the z-direction, and reference to the orthogonal coordinate system is made as appropriate.

Figure 4:
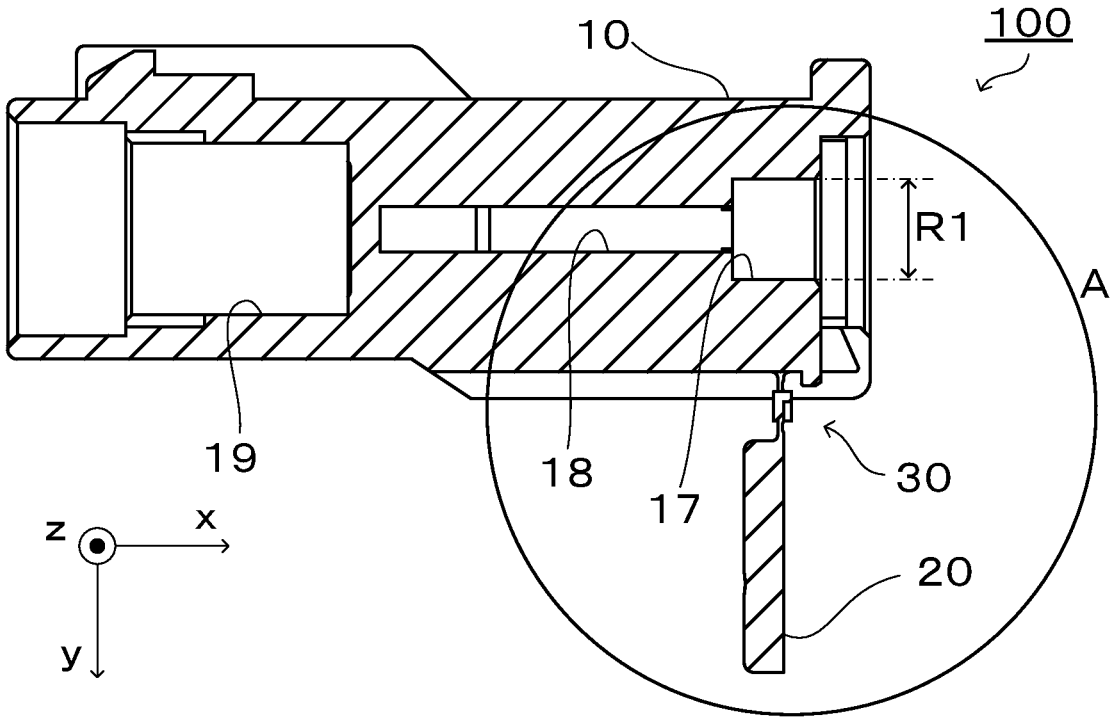
FIG. 4 is a cross-sectional view taken along the line IV-IV of FIG. 3.

The housing body 10 is made by molding a resin, and includes: a portion 11 for abutment, protruding in the y-direction and including a first projection 12 and a second projection 13; and an assembly container 14 that houses the assembly 20. Each of the first projection 12 and the second projection 13 protrudes in the y-direction from a flat portion 15 formed between the first projection 12 and the second projection 13 by a height h1, as illustrated in FIG. 3. Moreover, the first projection 12 and the second projection 13 are arranged at a spacing D1 in the z-direction. A space into which the assembly 20 fits and which has a rectangular parallelepiped shape is formed in the assembly container 14, and the periphery of the assembly container 14 includes a portion to be locked 16. Moreover, the housing body 10 includes: a gasket container 17 that houses the gasket 220; a cable container 18 that houses the cable 210; and a terminal container 19 that houses the terminal 200, as illustrated in FIG. 4. The inner diameter R1 of the gasket container 17 is smaller than the outer diameter of the gasket 220.

When being assembled to the housing body 10, the assembly 20 illustrated in FIG. 3 covers at least a part of the housing body 10 to fix the gasket 220 housed in the gasket container 17. A hole 21 into which the cable 210 is inserted, and a locker 22 that is locked in the portion to be locked 16 are formed in the assembly 20. The inner diameter R2 of the hole 21 is larger than the diameter of the cable 210, and is smaller than the inner diameter R1 of the gasket container 17. As a result, the assembly 20 enables the gasket 220 to be fixed to the housing body 10, and the cable 210 to be inserted.

As illustrated in FIG. 3, the hinge 30 includes: a connection 32 on which abutments 31*a* and 31*b* in a pair are formed; and a first joint 33 and a second joint 34 having flexibility. In the present embodiment, the abutments 31*a* and 31*b* in a pair are formed to be recessed in a surface, on which the portion 11 for abutment abuts, of the connection 32. Moreover, the abutments 31*a* and 31*b* in a pair are formed on both ends of the connection 32 in the z-direction, respectively. The abutments 31*a* and 31*b* in a pair are arranged at positions that can abut on the first projection 12 and the second projection 13 in the z-direction, respectively. The thick wall 31*c* is formed between the abutments 31*a* and 31*b* in a pair. The thick wall 31*c* is formed at a height at which the thick wall 31*c* does not come into contact with the flat portion 15 formed between the first projection 12 and the second projection 13 when the first joint 33 is bent to allow the abutments 31*a* and 31*b* and the first and second projections 12 and 13 to abut on each other.

Figure 5:
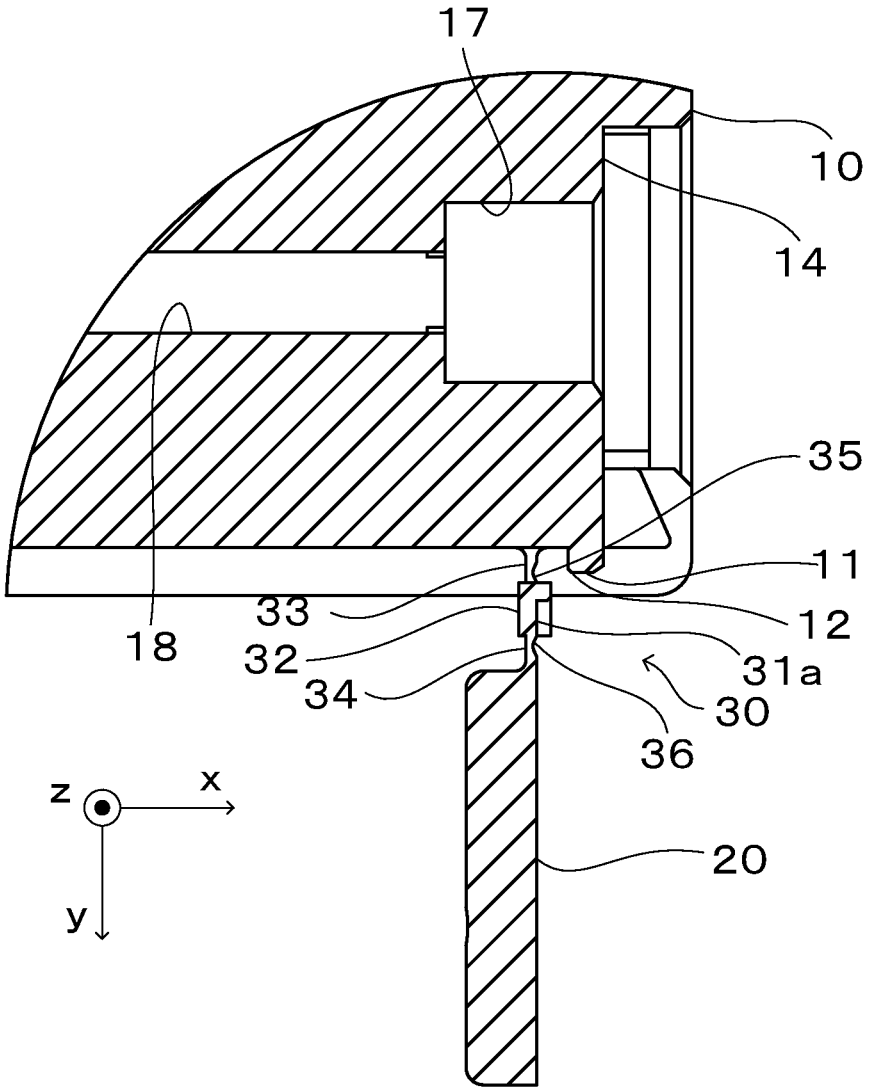
FIG. 5 is an enlarged view of the portion A of FIG. 4.

The first joint 33 is disposed between the housing body 10 and the connection 32, as illustrated in FIG. 5. The second joint 34 is disposed between the assembly 20 and the connection 32. Each of the bending angles of the first joint 33 and the second joint 34 is 90 degrees. Moreover, the total of the bending angle of the first joint 33 and the bending angle of the second joint 34 is 180 degrees. The first joint 33 includes the first flexible portion 35 that connects the housing body 10 and the connection 32 to each other, and has flexibility. The second joint 34 includes a second flexible portion 36 that connects the assembly 20 and the connection 32 to each other, and has flexibility. As illustrated in FIG. 3, a bend line L1 formed when the first flexible portion 35 is bent is parallel to a bend line L2 formed when the second flexible portion 36 is bent.

The length D2 of the first flexible portion 35 in the z-direction is equal to the length of the first joint 33 in the z-direction. Moreover, the length D3 of the second flexible portion 36 in the z-direction is equal to the length of the second joint 34 in the z-direction. The length D2 of the first flexible portion 35 in the z-direction is less than the length D3 of the second flexible portion 36 in the z-direction. As a result, the first joint 33 is more easily bent than the second joint 34. The length D3 of the second flexible portion 36 is preferably 1.2 times or more and 3 times or less, more preferably 1.5 times or more and 2 times or less, the length D2 of the first flexible portion 35. Moreover, the length D2 of the first flexible portion 35 is preferably less than the spacing D1 between the first and second projections 12 and 13 formed on the housing body 10. Such a manner enables the first flexible portion 35 and the first and second projections 12 and 13 to be easily integrally formed.

In the configuration described above, when the first flexible portion 35 is bent, the abutments 31*a* and 31*b* in a pair, formed on the connection 32 come into contact with the tops of the first projection 12 and the second projection 13, formed on the housing body 10, respectively. When the second flexible portion 36 is bent in a state in which the first flexible portion 35 is bent, the assembly 20 is housed in the assembly container 14, and assembled to the housing body 10.

The terminal 200 is a portion that is electrically connected to a mating terminal, as illustrated in FIG. 1. The terminal 200 is housed in the terminal container 19 (see FIG. 4) formed in the housing body 10.

The cable 210 is electrically connected to the terminal 200, and is housed in the cable container 18 (see FIG. 4) formed in the housing body 10.

Figure 7:
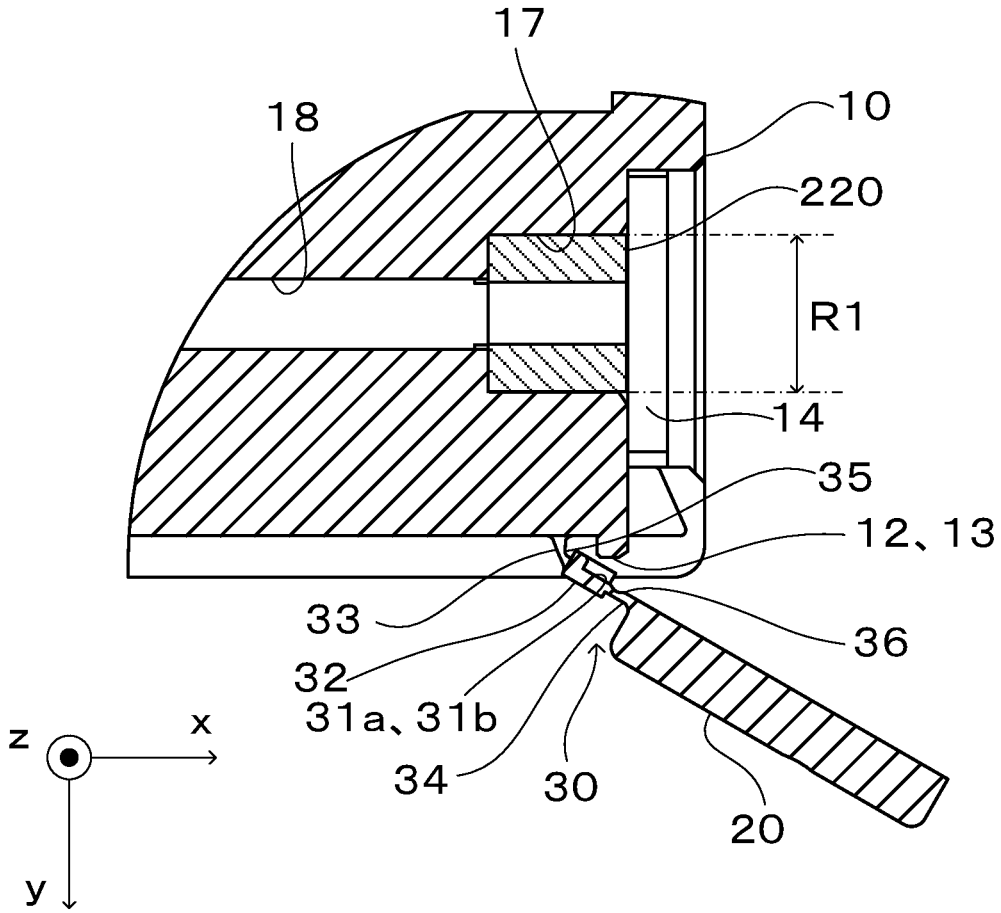
FIG. 7 is a view (1) illustrating a method of assembling the connector according to the embodiment of the present disclosure.

The gasket 220 is made of an elastic body such as rubber, and has a cylindrical shape. The gasket 220 achieves sealing between the housing body 10 and the cable 210. The gasket 220 is housed in the gasket container 17 formed in the housing body 10, as illustrated in FIG. 7. The outer diameter of the gasket 220 is larger than the inner diameter R1 of the gasket container 17. Moreover, the inner diameter of the gasket 220 is smaller than the outer diameter of the cable 210. As a result, the cable 210 is attached to the housing body 10 so that the cable 210 is sealed in the housing body 10.

A method of assembling the assembly 20 to the housing body 10 will now be described.

Figure 6:
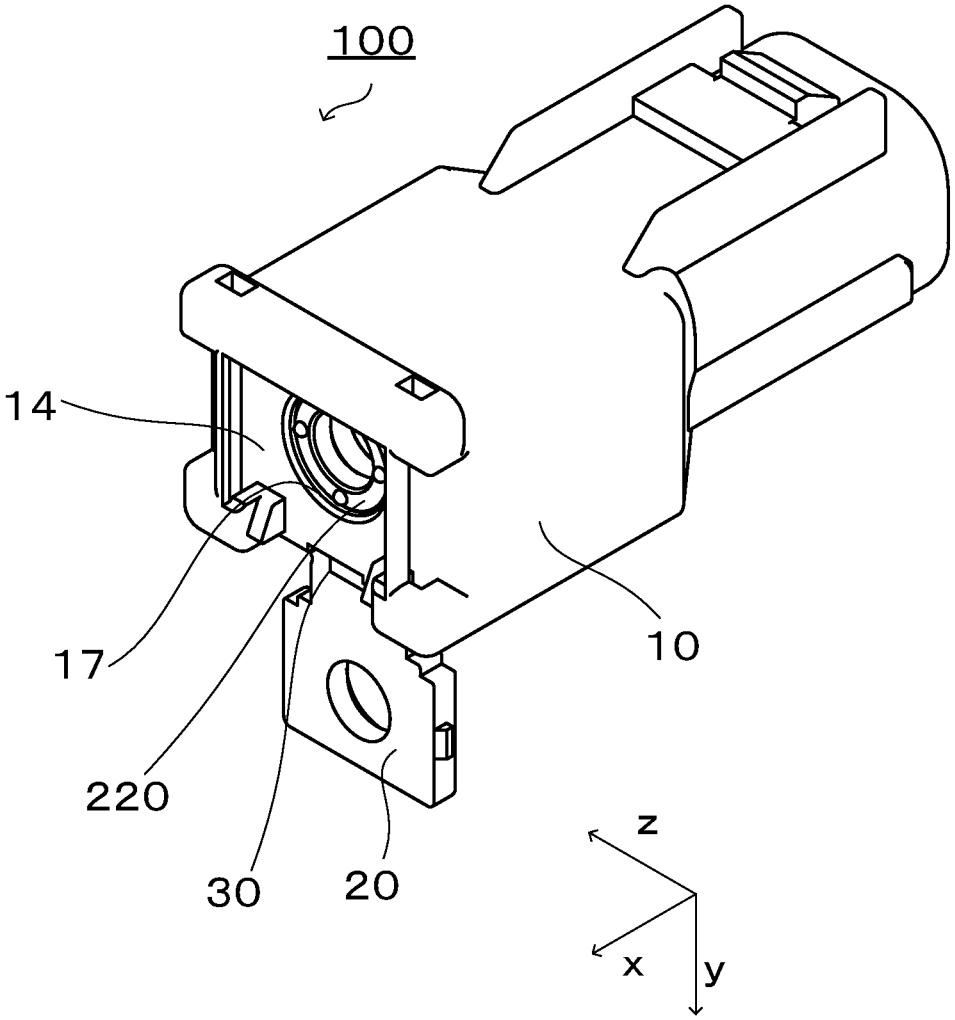
FIG. 6 is a perspective view illustrating a state in which a gasket is housed in the connector according to the embodiment of the present disclosure.

First, the gasket 220 is housed in the gasket container 17 formed in the housing body 10, as illustrated in FIG. 6. In such a case, the assembly 20 is arranged at a position rotated at 180 degrees from a position at which the assembly 20 is housed in the assembly container 14 formed in the housing body 10. As a result, easy working can be performed without interference of the assembly 20 when the gasket 220 is housed in the gasket container 17.

Then, application of force to the assembly 20 in the +x-direction results in bending of the first joint 33, as illustrated in FIG. 7. This is because the length D2 of the first flexible portion 35, in the z-direction, included in the first joint 33 is less than the length D3 of the second flexible portion 36, in the z-direction, included in the second joint 34, and therefore, the first joint 33 is more easily bent than the second joint 34.

Figure 8:
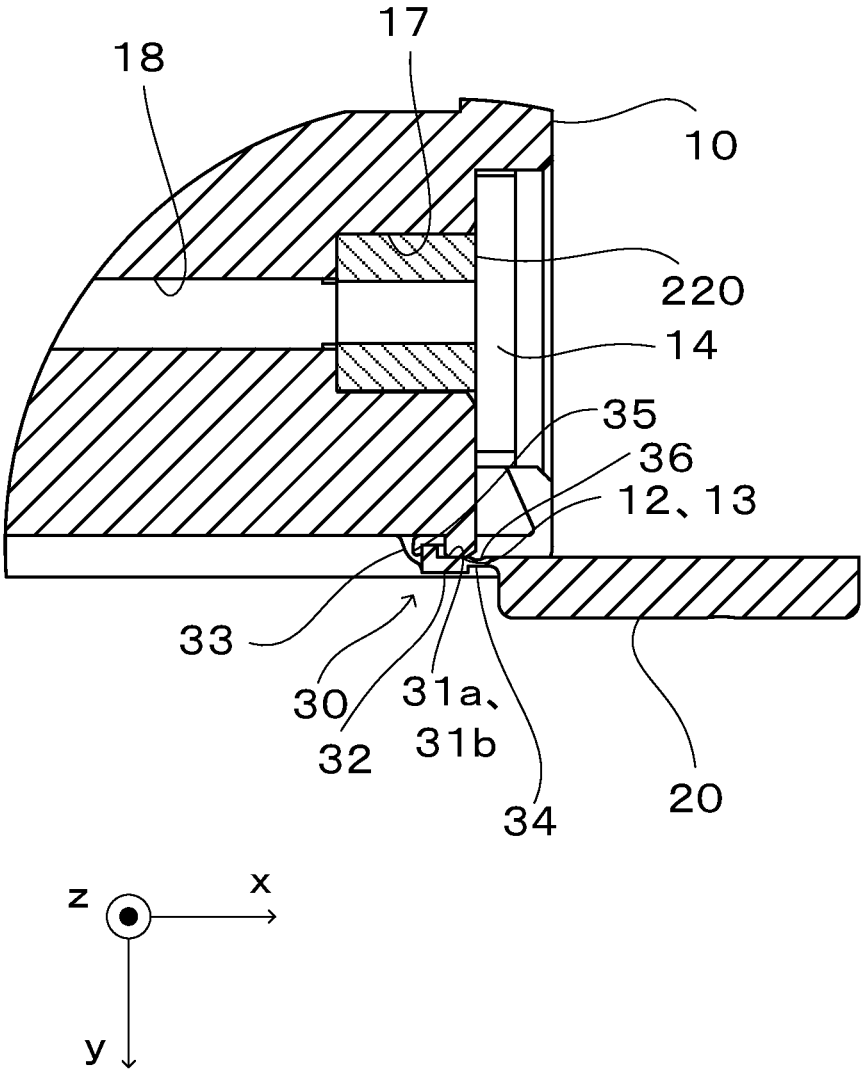
FIG. 8 is a view (2) illustrating a method of assembling the connector according to the embodiment of the present disclosure.

Then, application of force to the assembly 20 in the −y-direction results in bending of the first joint 33 at 90 degrees, to allow the abutments 31*a* and 31*b* in a pair, formed on the connection 32, to come into contact with the tops of the first projection 12 and the second projection 13 formed in the housing body 10, as illustrated in FIG. 8. In such a state, the second joint 34 is not bent, and the assembly 20 and the connection 32 are arranged in line with each other in the x-direction. Moreover, the abutments 31*a* and 31*b* in a pair come into contact with the tops of the first projection 12 and the second projection 13, and therefore, the position of the second joint 34 is fixed.

Figure 9:
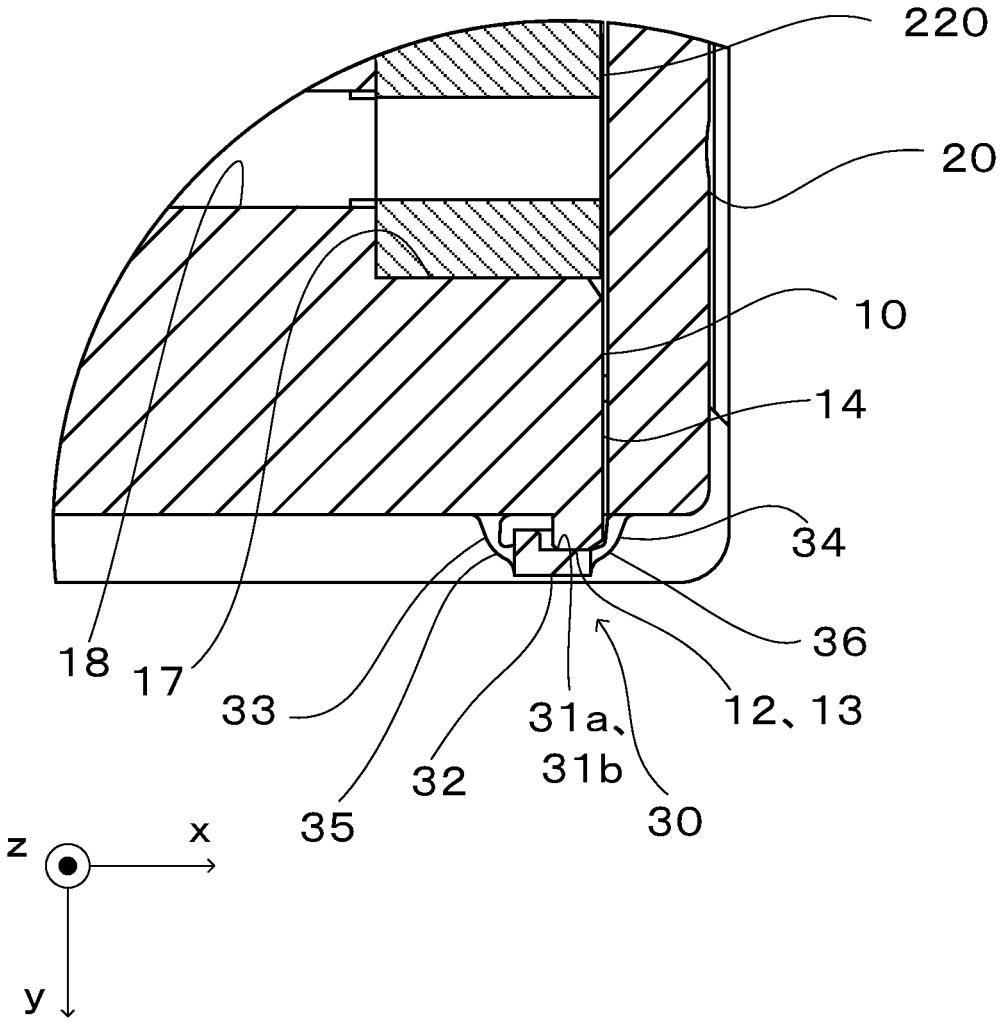
FIG. 9 is a view (3) illustrating a method of assembling the connector according to the embodiment of the present disclosure.

Then, rotation of the assembly 20 about the second joint 34 at 90 degrees allows the assembly 20 to be housed in the assembly container 14, as illustrated in FIG. 9. When the locker 22 formed on the assembly 20 illustrated in FIG. 3 is locked in the portion to be locked 16 formed on the assembly container 14, the assembly 20 is fixed to the housing body 10. The gasket 220 is fixed in the gasket container 17 formed in the housing body 10 by fixing the assembly 20 to the housing body 10.

Then, the cable 210 illustrated in FIG. 1 is inserted into the hole 21 (see FIG. 3) in the assembly 20, the hole in the gasket 220, and the cable container 18, and one end of the cable 210 is pulled out from the housing body 10. Then, the terminal 200 illustrated in FIG. 1 is crimped onto the one end of the cable 210. Then, the terminal 200 is housed in the terminal container 19 (see FIG. 4) of the housing body 10. As a result, the connector 1 is obtained.

As described above, the connector 1 and the housing 100 of the present embodiment include: the connection 32; and the hinge 30 including the first joint 33 and the second joint 34. As a result, it is possible to provide excellent workability, and to suppress breakage of the hinge 30. Specifically, when the first joint 33 is bent, the abutments 31*a* and 31*b* in a pair, formed on the connection 32, abuts on the portion 11 for abutment of the housing body 10, whereby the position of the second joint 34 is fixed. As a result, the assembly 20 can be rotated in a path determined in advance. In contrast, for example, in a case in which a hinge includes one joint, bending of the hinge may result in application of load to a place other than the joint in the hinge to deform the hinge. Accordingly, an assembly is prevented from being rotated in a path determined in advance, whereby the assembly is precluded from being housed in the assembly container of a housing body. In contrast, in the present embodiment, the assembly 20 can be easily housed in the assembly container 14 of the housing body 10 because the assembly 20 can be rotated in the path determined in advance. As a result, the connector 1 has excellent workability. Moreover, the hinge 30 includes the first joint 33 and the second joint 34, whereby load caused by bending is dispersed into the first joint 33 and the second joint 34 in comparison with, for example, a hinge including one joint, and therefore, breakage of the hinge 30 can be suppressed.

Moreover, each of the bending angles of the first joint 33 and the second joint 34 is 90 degrees, and therefore, the hinge 30 can be rotated at 180 degrees. The rotation of the hinge 30 at 180 degrees enables easy working to be performed without interference of the assembly 20 when a component such as the gasket 220 is housed in the housing body 10. Moreover, the length D2 of the first flexible portion 35 is less than the length D3 of the second flexible portion 36. As a result, the first joint 33 is more easily bent than the second joint 34. Since the first joint 33 is more easily bent than the second joint 34, the first joint 33 is bent prior to bending of the second joint 34, and the abutments 31*a* and 31*b* in a pair, formed on the connection 32, come into contact with the tops of the first projection 12 and the second projection 13, formed in the housing body 10, respectively. When the second joint 34 is then bent in a state in which the first joint 33 is bent, the assembly 20 is assembled to the assembly container 14 formed in the housing body 10. When the assembly 20 is assembled to the housing body 10, the abutments 31*a* and 31*b* in a pair, formed on the connection 32, come into contact with the tops of the first projection 12 and the second projection 13, as illustrated in FIG. 9. Therefore, even when force is applied to the connection 32 in the −y-direction, the first projection 12 and the second projection 13 receive the applied force, and therefore, the force is applied to neither the first joint 33 nor the second joint 34. Thus, breakage of the hinge 30 can be prevented. The portion 11 for abutment formed on the housing body 10 includes the first projection 12 and the second projection 13, whereby the position of the connection 32 can be accurately determined.

ALTERNATIVE EXAMPLE

In the embodiment described above, the example has been described in which the length D2 of the first flexible portion 35 of the hinge 30 is less than the length D3 of the second flexible portion 36, and therefore, the first joint 33 is more easily bent than the second joint 34. However, the present disclosure is not limited thereto. For example, it is acceptable that a first joint 33 and a second joint 34 are made of an identical material, and the thickness of the thinnest portion in the first joint 33 is smaller than the thickness of the thinnest portion in the second joint 34, whereby the first joint 33 is more easily bent than the second joint 34. In such a case, it is preferable that the length D2 of a first flexible portion 35 is equal to the length D3 of a second flexible portion 36. In such a manner, an assembly 20 can be prevented from falling in the z-direction. Depending on the shape or application of a housing 100, it is acceptable that the degrees of the easiness of bending of the first joint 33 and the second joint 34 are the same as each other.

In the embodiment described above, the example has been described in which the first joint 33 includes the first flexible portion 35 having flexibility, and the second joint 34 includes the second flexible portion 36 having flexibility. However, the present disclosure is not limited thereto. It is preferable that each of a first joint 33 and a second joint 34 can be bent. For example, the first joint 33 and the second joint 34 may be bent due to a structure including a shaft and a cylinder penetrated by the shaft.

In the embodiment described above, the example has been described in which each of the bending angles of the first joint 33 and the second joint 34 is 90 degrees, and the total of the bending angles of the first joint 33 and the second joint 34 is 180 degrees. However, the present disclosure is not limited thereto. For example, each of the bending angles of a first joint 33 and a second joint 34, and the total of the bending angles of the first joint 33 and the second joint 34 is optional, and can be optionally set depending on the shape or application of a housing 100.

In the embodiment described above, the example has been described in which the gasket 220 housed in the gasket container 17 of the housing body 10 is fixed with the assembly 20. However, the present disclosure is not limited thereto. It is preferable that an assembly 20 is detachably assembled to a housing body 10. For example, the assembly 20 may be a dustproof, dripproof, or waterproof cover that covers a part of the housing body 10. The assembly 20 may be, for example, a retainer with which a terminal 200 is locked. The shape or size of the assembly 20 is not particularly limited. The assembly 20 may have an optional shape and an optional size.

In the embodiment described above, the example has been described in which the abutments 31*a* and 31*b* in a pair are formed to be recessed, the portion 11 for abutment includes the first projection 12 and the second projection 13, and the abutments 31*a* and 31*b* and the tops of the first projection 12 and the second projection 13 come into contact with each other when the first joint 33 is bent. However, the present disclosure is not limited thereto, and it is preferable that abutments 31*a* and 31*b* have configurations in which the abutments 31*a* and 31*b* abut on a portion 11 for abutment. For example, it is acceptable that the abutments 31*a* and 31*b* have projections, and the portion 11 for abutment is formed on the same plane as the plane of a flat portion 15.

Figure 10:
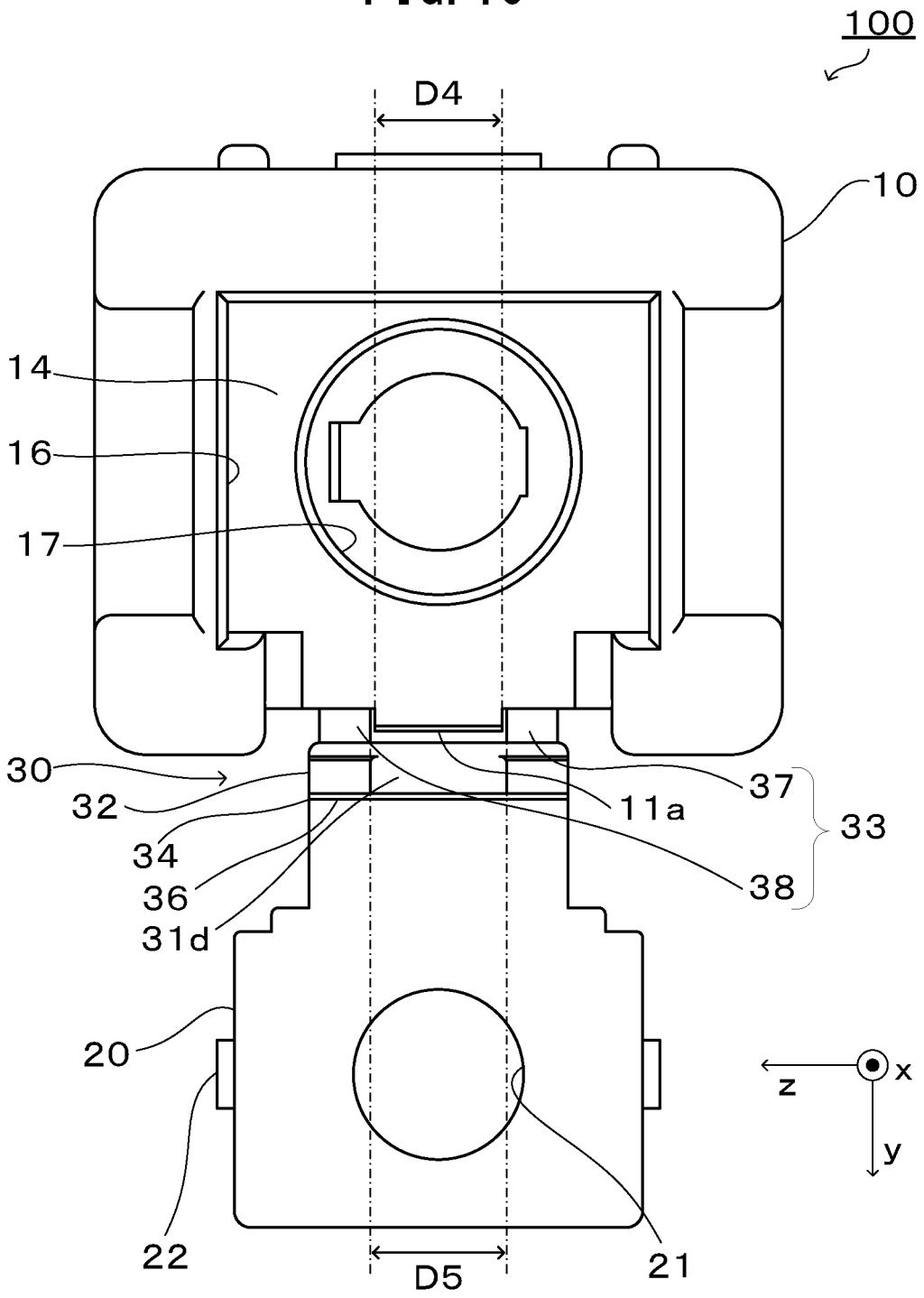
FIG. 10 is a front view illustrating a housing according to an alternative example of the present disclosure.

In the embodiment described above, the example has been described in which the portion 11 for abutment formed on the housing body 10 includes the first projection 12 and the second projection 13. However, the present disclosure is not limited thereto. It is preferable that abutments 31*a* and 31*b* formed on the connection 32 of a hinge 30 come into contact with a portion 11 for abutment. The portion 11 for abutment may also include at least one projection. For example, a projection 11*a* may be formed on a housing body 10, as illustrated in FIG. 10. In such a case, it is also acceptable that an abutment 31*d* is formed on the connection 32 of the hinge 30, and the first joint 33 of the hinge 30 includes a third flexible portion 37 and a fourth flexible portion 38. In such a manner, the assembly 20 can be prevented from falling in the z-direction. The length D4 of the projection lla in the z-direction may be less than a spacing D5 between the third flexible portion 37 and the fourth flexible portion 38 in the z-direction. In such a manner, the projection Ila and the third and fourth flexible portions 37 and 38 can be easily integrally formed.

The foregoing describes some example embodiments for explanatory purposes. Although the foregoing discussion has presented specific embodiments, persons skilled in the art will recognize that changes may be made in form and detail without departing from the broader spirit and scope of the invention. Accordingly, the specification and drawings are to be regarded in an illustrative rather than a restrictive sense. This detailed description, therefore, is not to be taken in a limiting sense, and the scope of the invention is defined only by the included claims, along with the full range of equivalents to which such claims are entitled.

INDUSTRIAL APPLICABILITY

The present disclosure is used for electrically connecting an electronic circuit, of which examples include an electronic circuit for automobile use.

REFERENCE SIGNS LIST

1 Connector
10 Housing body
11 Portion for abutment
11*a* Projection
12 First projection
13 Second projection
14 Assembly container
15 Flat portion
16 Portion to be locked
17 Gasket container
18 Cable container
19 Terminal container
20 Assembly
21 Hole
22 Locker
30 Hinge
31*a*, 31*b*, 31*d* Abutment
31*c* Thick wall
32 Connection
33 First joint
34 Second joint
35 First flexible portion
36 Second flexible portion
37 Third flexible portion
38 Fourth flexible portion
100 Housing
200 Terminal
210 Cable
220 Gasket
D1, D5 Spacing
D2 to D4 Length
L1, L2 Bend line
h1 Height
R1, R2 Inner diameter

What is claimed is:

1. A housing comprising:

a housing body on which a portion for abutment is formed;

an assembly that is detachably assembled to the housing body; and a hinge with which the assembly is mounted on the housing body, and that comprises (i) a connection that is arranged between the housing body and the assembly, and on which an abutment is formed, (ii) a first joint that is disposed between the housing body and the connection, and has flexibility, and (iii) a second joint that is disposed between the assembly and the connection, and has flexibility, wherein the abutment formed on the connection is allowed to abut on the portion for abutment of the housing body by bending the first joint, and the assembly is assembled to the housing body by bending the second joint in a state in which the first joint is bent, the first joint comprises a first flexible portion that connects the housing body and the connection to each other, and has flexibility, and the second joint comprises a second flexible portion that connects the assembly and the connection to each other, and has flexibility.

2. The housing according to claim 1, wherein the first joint is more easily bent than the second joint.

3. The housing according to claim 1, wherein a total of a bending angle of the first joint and a bending angle of the second joint is 180 degrees.

4. The housing according to claim 3, wherein each of the bending angles of the first joint and the second joint is 90 degrees.

5. The housing according to claim 1, wherein a length of the first flexible portion in a direction along a bend line formed when the first flexible portion is bent is less than a length of the second flexible portion in a direction along a bend line formed when the second flexible portion is bent.

6. The housing according to claim 1, wherein the first joint and the second joint are made of an identical material, and a thickness of a thinnest portion in the first joint is smaller than a thickness of a thinnest portion in the second joint.

7. A housing comprising:

a housing body on which a portion for abutment is formed;

an assembly that is detachably assembled to the housing body; and a hinge with which the assembly is mounted on the housing body, and that comprises (i) a connection that is arranged between the housing body and the assembly, and on which an abutment is formed, (ii) a first joint that is disposed between the housing body and the connection, and has flexibility, and (iii) a second joint that is disposed between the assembly and the connection, and has flexibility, wherein the abutment formed on the connection is allowed to abut on the portion for abutment of the housing body by bending the first joint, and the assembly is assembled to the housing body by bending the second joint in a state in which the first joint is bent, the portion for abutment, formed on the housing body, comprises at least one projection, and the abutment and a top of the projection come into contact with each other when the first joint is bent.

8. A housing comprising:

a housing body on which a portion for abutment is formed;

an assembly that is detachably assembled to the housing body; and a hinge with which the assembly is mounted on the housing body, and that comprises (i) a connection that is arranged between the housing body and the assembly, and on which an abutment is formed, (ii) a first joint that is disposed between the housing body and the connection, and has flexibility, and (iii) a second joint that is disposed between the assembly and the connection, and has flexibility, wherein the abutment formed on the connection is allowed to abut on the portion for abutment of the housing body by bending the first joint, and the assembly is assembled to the housing body by bending the second joint in a state in which the first joint is bent, the portion for abutment, formed on the housing body, comprises a first projection and a second projection, and the abutment and tops of the first projection and the second projection come into contact with each other when the first joint is bent.

9. The housing according to claim 8, wherein a length of the first joint in a direction along a bend line formed when the first joint is bent is less than a spacing between the first projection and the second projection.

10. A housing comprising:

a housing body on which a portion for abutment is formed;

an assembly that is detachably assembled to the housing body; and a hinge with which the assembly is mounted on the housing body, and that comprises (i) a connection that is arranged between the housing body and the assembly, and on which an abutment is formed, (ii) a first joint that is disposed between the housing body and the connection, and has flexibility, and (iii) a second joint that is disposed between the assembly and the connection, and has flexibility, wherein the abutment formed on the connection is allowed to abut on the portion for abutment of the housing body by bending the first joint, and the assembly is assembled to the housing body by bending the second joint in a state in which the first joint is bent, the first joint comprises a third flexible portion and a fourth flexible portion that connect the housing body and the connection to each other and have flexibility, the portion for abutment, formed on the housing body, comprises one projection, and a length of the projection in a direction along a bend line formed when the first joint is bent is less than a spacing between the third flexible portion and the fourth flexible portion.

11. A connector comprising:

the housing according to claim 1; and a terminal housed in the housing.

12. A connector comprising:

the housing according to claim 7; and a terminal housed in the housing.

13. A connector comprising:

the housing according to claim 8; and a terminal housed in the housing.

14. A connector comprising:
the housing according to claim 10; and
a terminal housed in the housing.

* * * * *